US010286697B2

(12) United States Patent
Hayashi

(10) Patent No.: US 10,286,697 B2
(45) Date of Patent: May 14, 2019

(54) PRINTING APPARATUS

(71) Applicant: SEIKO EPSON CORPORATION, Tokyo (JP)

(72) Inventor: Seiya Hayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/918,876

(22) Filed: Mar. 12, 2018

(65) Prior Publication Data

US 2018/0272771 A1 Sep. 27, 2018

(30) Foreign Application Priority Data

Mar. 23, 2017 (JP) ..... 2017-057140

(51) Int. Cl.

| | |
|---|---|
| ***B41J 29/02*** | (2006.01) |
| ***B41J 2/045*** | (2006.01) |
| ***B41J 2/175*** | (2006.01) |
| ***B41J 29/00*** | (2006.01) |

(52) U.S. Cl.

CPC ..... *B41J 29/02* (2013.01); *B41J 2/04501* (2013.01); *B41J 2/1752* (2013.01); *B41J 29/00* (2013.01); *B41J 2/17526* (2013.01)

(58) Field of Classification Search

CPC .... B41J 29/02; B41J 2/04501; B41J 2/17566; B41J 2/17513; B41J 2/1752; B41J 29/00; B41M 3/00; G01F 23/26

See application file for complete search history.

(56) References Cited

U.S. PATENT DOCUMENTS

| | | | | |
|---|---|---|---|---|
| 5,096,316 | A | 3/1992 | Otsuka et al. | |
| 8,708,469 | B2 * | 4/2014 | Kodama | B41J 2/1752 347/50 |
| 9,555,633 | B2 * | 1/2017 | Ohnishi | B41J 2/16508 |
| 2008/0252670 | A1 | 10/2008 | Labar | |
| 2010/0226683 | A1 | 9/2010 | Yamaguchi | |
| 2014/0247304 | A1 | 9/2014 | Wakabayashi | |

FOREIGN PATENT DOCUMENTS

| | | | |
|---|---|---|---|
| JP | 0752377 | A | 2/1995 |
| JP | 2004130622 | A | 4/2004 |
| JP | 2010-210834 | A | 9/2010 |
| JP | 2016-022626 | A | 2/2016 |

OTHER PUBLICATIONS

European Search Report issued in Application No. 18162507 dated Jul. 18, 2018.

* cited by examiner

*Primary Examiner* — Thinh H Nguyen
(74) *Attorney, Agent, or Firm* — Workman Nydegger

(57) ABSTRACT

A printing apparatus includes a printing section configured to perform printing onto a medium while reciprocating in a movement area, and an attachment section to which a circuit board can be attached. The attachment section is movable between a first position above the movement area and a second position which is at least partially within the movement area.

4 Claims, 3 Drawing Sheets

PRINTING APPARATUS

BACKGROUND

1. Technical Field

The present invention relates to printing apparatuses such as printers.

2. Related Art

Examples of the printing apparatuses include ink jet recording apparatuses having a cartridge attachment section for attaching a liquid pack in the upper part of a housing. JP-A-2016-22626 is an example of related art.

The cartridge attachment section located at a raised position may cause difficulty in visual observation of the position for attaching or detaching the liquid pack. Not only in the case of attaching the liquid pack in the cartridge attachment section, but also in the case where an attachment section for attaching a component is located at a position that cannot be easily observed, operations may become troublesome.

SUMMARY

An advantage of some aspects of the invention is that a printing apparatus that enables ease of attachment and detachment of a component is provided.

The printing apparatus for solving the above problem includes a printing section configured to perform printing onto a medium while reciprocating in a movement area, and an attachment section to which a component can be attached, wherein the attachment section is movable between a first position above the movement area and a second position which is at least partially within the movement area.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to drawings, an embodiment of a printing apparatus will be described. The printing apparatus is, for example, an ink jet printer that performs printing by ejecting ink which is an example of the liquid onto a medium such as a paper sheet.

Figure 1:
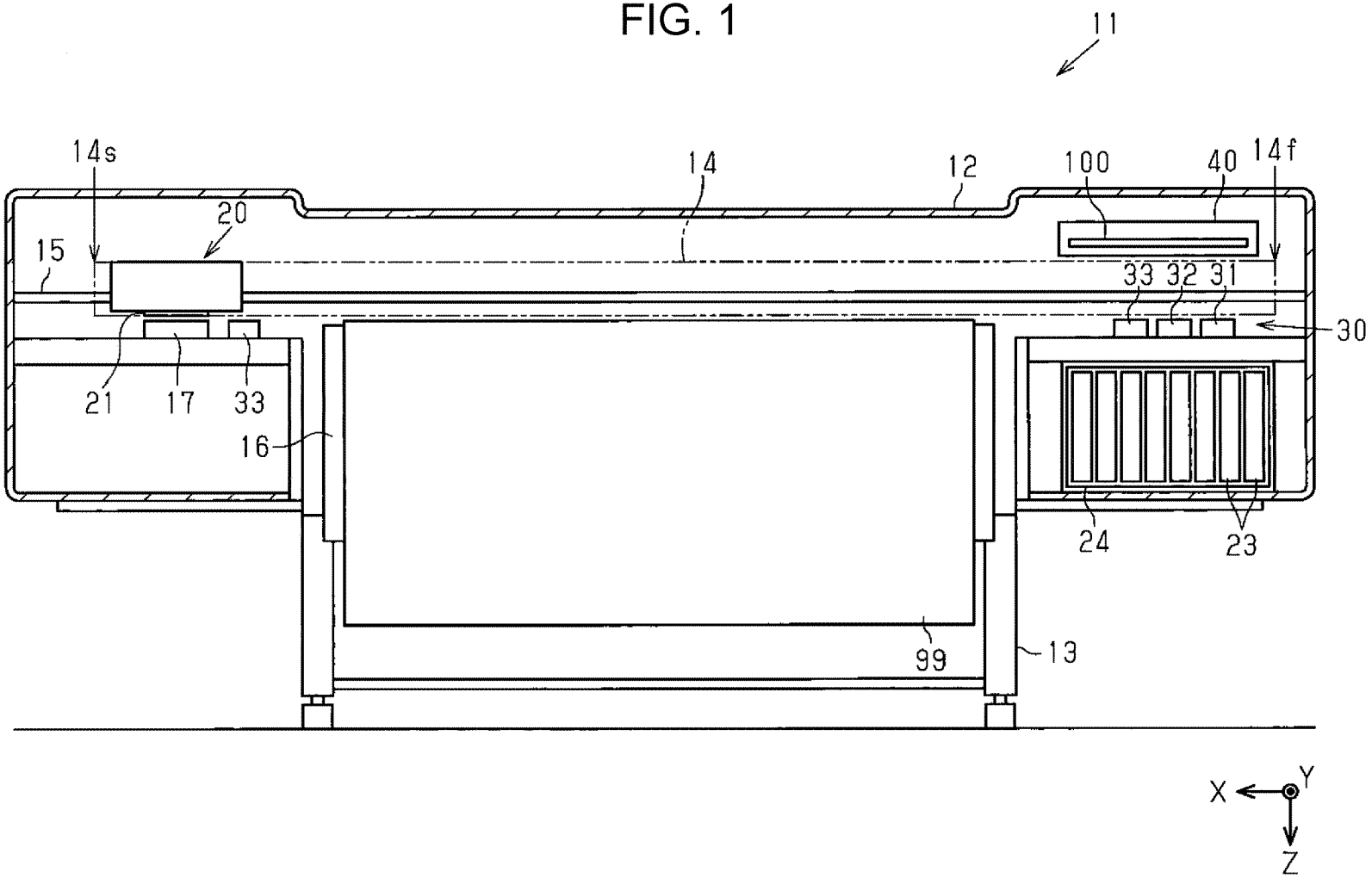
FIG. 1 is an overall configuration diagram of an embodiment of a printing apparatus.

As shown in FIG. 1, a printing apparatus 11 includes a housing 12, legs 13 that support the housing 12, a printing section 20, a maintenance mechanism 30, and an attachment section 24 on which a liquid container 23 can be attached. The printing section 20, the maintenance mechanism 30, and the attachment section 24 are housed in the housing 12. The printing section 20 includes an ejecting head 21 to which nozzles 22 (see FIG. 3) are open so that liquid is ejected therethrough. The liquid container 23 is a tank that can store the liquid to be supplied to the printing section 20. Alternatively, the liquid container 23 may be a cartridge, which is a replaceable container.

The printing section 20 is configured to perform printing onto a medium 99 while reciprocating in a movement area 14 which extends in a longitudinal direction of the housing 12. After printing is performed, the medium 99 is transported in a direction Y to the outside the housing 12, and is hung in a gravitational direction Z. One and the other ends of the movement area 14 in the longitudinal direction are referred to as a first end 14*f* and a second end 14*s*, respectively. In the figure, a direction from the first end 14*f* to the second end 14*s* is indicated as a direction X. The direction X, the direction Y, and the gravitational direction Z form a three-axis system.

The printing apparatus 11 includes a guide shaft 15 that guides movement of the printing section 20, a medium support section 16 that can support the medium 99, a circuit board 100 which is an example of a component, and an attachment section 40 to which the circuit board 100 can be attached, which are housed in the housing 12. The circuit board 100 is a control unit that controls constituent elements of the printing apparatus 11 such as the printing section 20.

The medium support section 16 is disposed between the first end 14*f* and the second end 14*s* in the longitudinal direction of the movement area 14. The medium support section 16 preferably has an end portion extending outside the housing 12 so as to support the medium 99 which is outputted outside the housing 12.

When in printing, the printing section 20 reciprocates between the first end 14*f* and the second end 14*s* of the movement area 14 while traversing the medium support section 16. When not in printing, the printing section 20 stands-by at a stand-by position which is closer to the second end 14*s* than to the medium support section 16. In this case, the attachment section 40 is preferably disposed at a position closer to the first end 14*f* than to the medium support section 16. The printing section 20 shown in FIG. 1 is located at the stand-by position. A cap 17 is preferably disposed at the stand-by position so as to cover the nozzles 22 (see FIG. 3).

The maintenance mechanism 30 is disposed, for example, at a position closer to the first end 14*f* than to the medium support section 16. The maintenance mechanism 30 includes at least one of a wiping member 31, a suction mechanism 32, and a waste liquid receiver 33. The wiping member 31 wipes foreign substances such as liquid adhered to the ejecting head 21 while moving relative to the ejecting head 21. The suction mechanism 32 suctions the ejecting head 21 through the nozzles 22 to thereby purge foreign substances such as air bubbles residing in the printing section 20. The waste liquid receiver 33 receives the ejected waste liquid when the printing section 20 ejects liquid as waste liquid. The waste liquid receiver 33 may also be disposed at a position between the medium support section 16 and the second end 14*s*.

Figure 2:
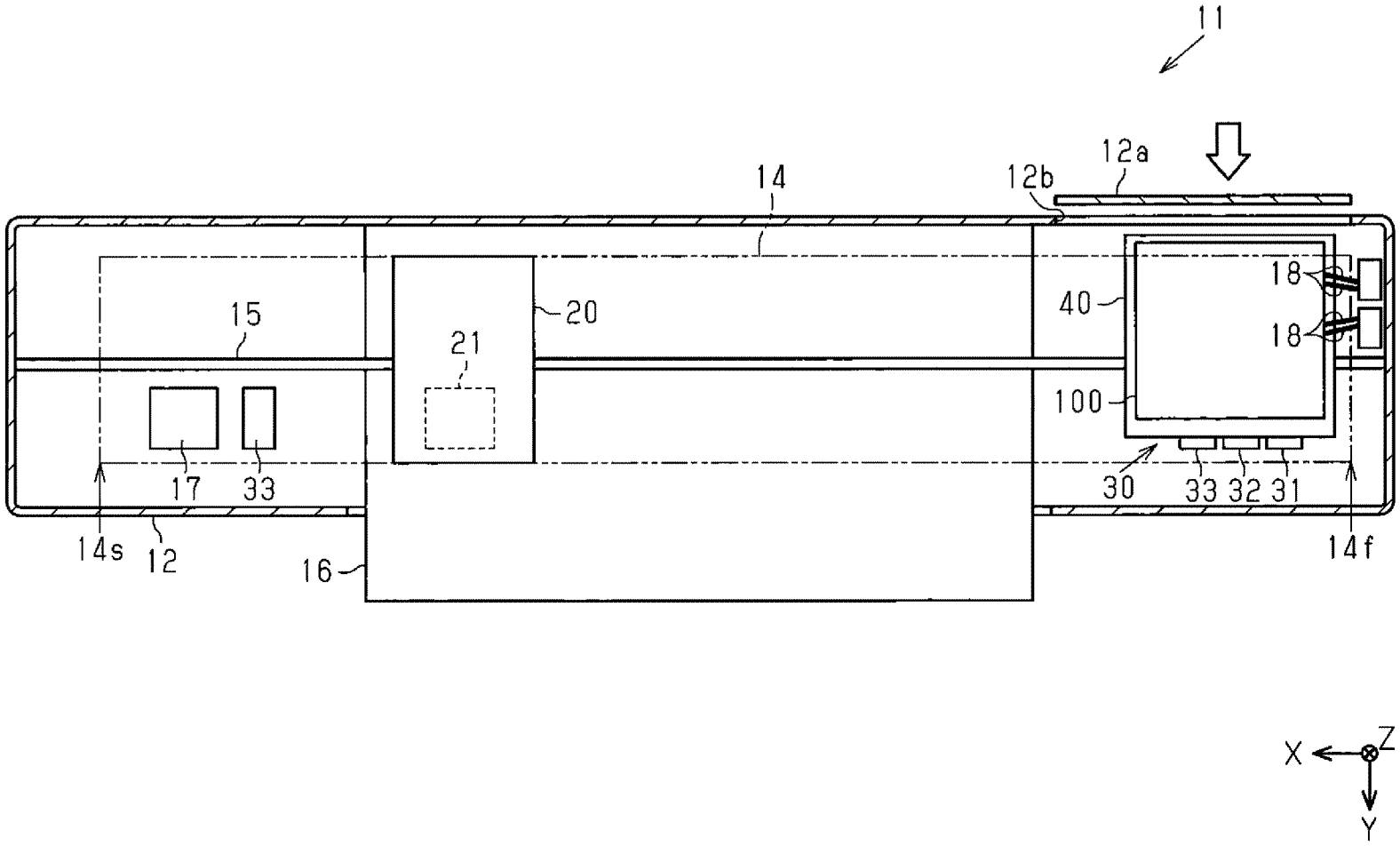
FIG. 2 is a plan view which schematically illustrates an inner configuration of the printing apparatus of FIG. 1.

As shown in FIG. 2, one or more cables 18 are detachably attached to the circuit board 100. The cable 18 is an example of a component detachably attached to the circuit board 100 which is mounted on a fixation frame 41. For example, the cable 18 may be a line for transmitting electric power to the circuit board 100 or may be a line for transmitting a signal to the printing section 20. The cable 18 may be a flexible flat cable or a wire harness, which is an assembly of a plurality of lines.

A wall of the housing 12 which faces the attachment section 40 is preferably a removable cover 12*a*. When the cover 12*a* is removed, the attachment section 40 can be visually observed. The cover 12*a* can be disposed on the rear side of the housing 12 taking the surface of the housing 12 from which the medium 99 is outputted as the front side.

Figure 3:
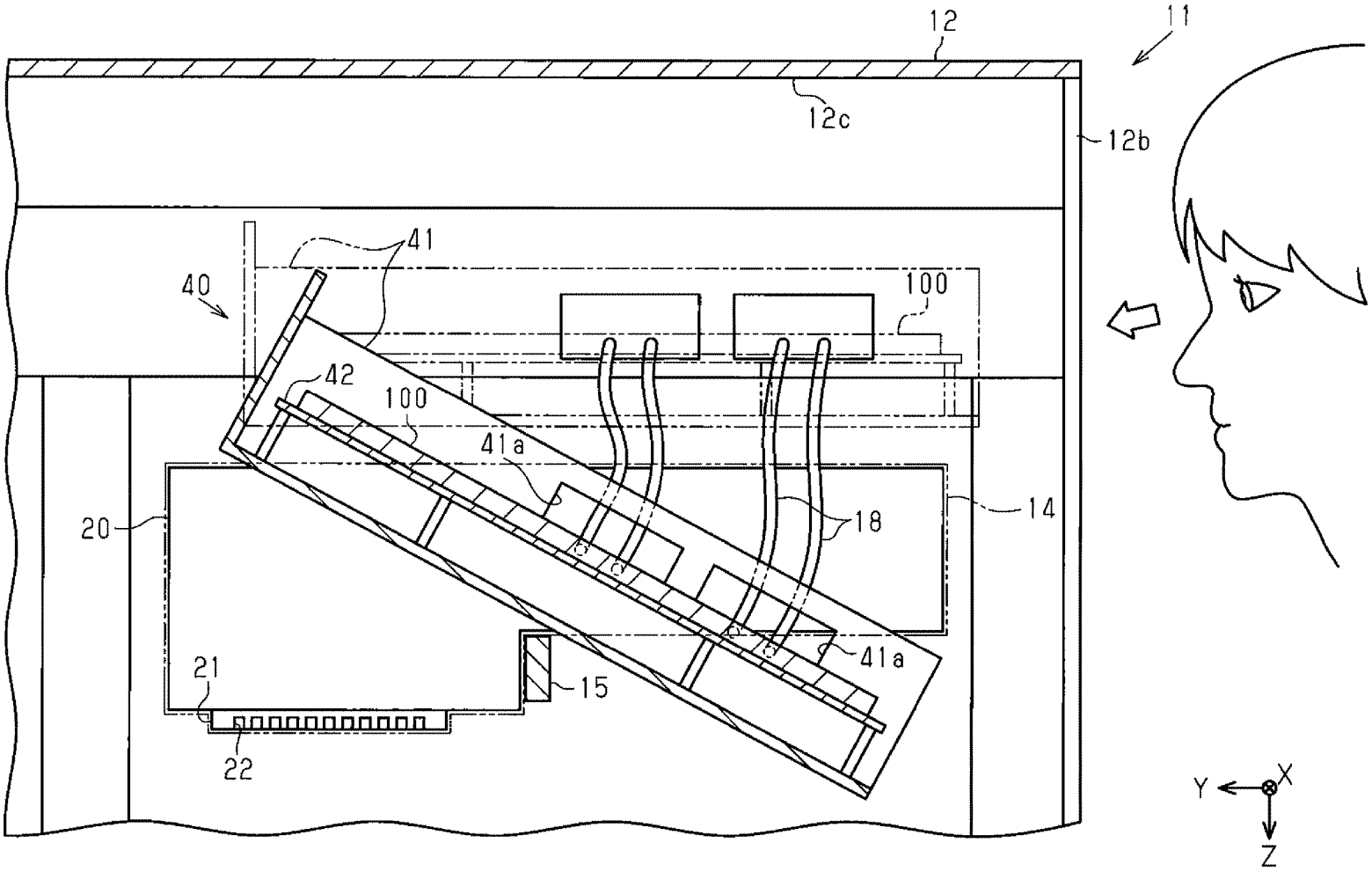
FIG. 3 is a cross-sectional view which illustrates that an attachment section of the printing apparatus of FIG. 1 is at a second position.

In FIGS. 2 and 3, the white arrow indicates the gaze of a user looking at the attachment section 40 in the housing 12 with the cover 12*a* being removed. In FIG. 3, the housing 12 is shown with the cover 12*a* removed. A portion of the housing 12 from which the cover 12*a* is removed is an opening 12*b*.

As shown in FIG. 3, the attachment section 40 is movable between a first position (the position indicated by the double-dotted and dashed line) above the movement area 14 and a second position (the position indicated by the solid line) which is at least partially within the movement area 14. The attachment section 40 is preferably fixed by a fastener such as a screw when located at the first position. In this case, the attachment section 40 moves to the second position by its own weight when released from the fixed state.

The attachment section 40 preferably includes the fixation frame 41 on which the circuit board 100 can be mounted. The fixation frame 41 preferably has an aperture 41*a* that allows the cable 18 to pass therethrough. The cable 18 is preferably flexed so as to follow movement of the fixation frame 41. The attachment section 40 may also include a table 42 for carrying the circuit board 100. A gap is formed between the table 42 and the fixation frame 41 to promote heat dissipation of the circuit board 100. Further, a fastener such as a screw can protrude into the gap.

The attachment section 40 is preferably configured to be tiltable between the first position and the second position. For example, the bottom of the fixation frame 41 is substantially horizontal at the first position, and the bottom of the fixation frame 41 is tilted to the horizontal at the second position. When the end of the fixation frame 41 more spaced from the opening 12*b* is referred to as a proximal end and the end closer to the opening 12*b* is referred to as a distal end, the fixation frame 41 is preferably tilted with the distal end moving downward from the first position to the second position.

The fixation frame 41 can be formed in a plate or box shape. The fixation frame 41 is disposed to face the inner surface (for example, a ceiling surface 12*c*) of the housing 12 when located at the first position so that the circuit board 100 is protected by the housing 12. However, when the fixation frame 41 faces the ceiling surface 12*c*, it is difficult to visually observe the circuit board 100. Therefore, in the second position, it is preferred that a portion of the fixation frame 41 on which the circuit board 100 is mounted is oriented to the outside the housing 12 to a more extent than in the first position.

Next, effects and advantageous of the printing apparatus 11 configured as above will be described. The attachment section 40 is disposed at the first position above the movement area 14 during an operation such as printing in which the printing section 20 moves. As a result, the printing section 20 when moving does not come into contact with the attachment section 40. When in maintenance of surroundings of the circuit board 100, the user stops the printing section 20 at the stand-by position and removes the cover 12*a* from the housing 12. Then, the user moves the attachment section 40 from the first position to the second position. Since the printing section 20 is located at the stand-by position, it does not come into contact with the attachment section 40 when the attachment section 40 moves.

As the attachment section 40 moves, the distal end of the fixation frame 41 comes at a position lower than the distal end. Accordingly, the circuit board 100 held by the fixation frame 41 comes to a position that can be easily observed. As a result, a maintenance operation such as inspection of the circuit board 100 and replacement of the circuit board 100 can be smoothly performed. The maintenance operation also includes inspection, re-insertion, and replacement of the cable 18.

According to the printing apparatus 11 of the present embodiment, the following effects can be obtained.

(1) When the attachment section 40 is located in the housing 12, the circuit board 100 is concealed and not easily observed. Therefore, when the attachment section 40 is moved to a position close to the opening 12*b*, the maintenance operation can be smoothly performed.

(2) Since the housing 12 is disposed on the legs 13, the housing 12 is at a raised position, which causes difficulty in visual observation of the housing 12. Therefore, when the attachment section 40 is moved to a lower position, the maintenance operation can be smoothly performed.

(3) When the second position of the attachment section 40 overlaps the movement area 14, a space in the housing 12 can be efficiently used since the movable range of the attachment section 40 does not need to be reserved.

(4) The movement area 14 is larger than the movable range of the attachment section 40. Accordingly, a working space for a maintenance operation can be provided around the attachment section 40 in the second position.

(5) When the position at which an attachment operation is performed is easily observed, errors in operation such as erroneous connection of the cable 18, oblique insertion of the circuit board 100, and damages due to collision of the components can be reduced.

(6) When the attachment section 40 is located at a raised position, a step or the like is necessary for smooth operation. Further, use of the step may cause poor footing. However, since the attachment section 40 is moved to a lower position, the operation can be safely performed without using a step.

The above embodiment may be changed as described in the following modified examples. The configurations included in the above embodiment can be combined with the configurations included in the following modified examples as appropriate. Further, each of the configurations included in the following modified examples may be combined as appropriate.

The attachment section 24 can be movable. In this case, a component attached to the attachment section 24 may be the liquid container 23 or a waste liquid container that stores waste liquid discharged by a suctioning operation or the like. The attachment section 24 is preferably configured to move, for example, from the first position which is shown in FIG. 1 to the second position lower than the first position. In this configuration, the attachment section 40 may protrude downward from the bottom of the housing 12.

The attachment sections 24 and 40 may be slidable in the vertical or horizontal direction.

In the housing 12, the attachment section 24 may be disposed above the printing section 20 and may be movable between the first position above the movement area 14 and the second position which is at least partially within the movement area 14.

The attachment section 40 or the attachment section 24 may be disposed immediately above the medium support section 16.

Liquid ejected from the printing section 20 is not limited to ink, and may be, for example, a liquid material which is made by dispersing or mixing a particle of a functional material in liquid. For example, the printing section 20 may be configured to eject a liquid material which includes dispersed or mixed material such as electrode material or color material (pixel material) used for production of liquid crystal displays, EL (electroluminescence) displays and surface emission displays.

The medium 99 is not limited to a paper sheet, and may be a plastic film or a thin plate, or alternatively, a cloth used in a fabric printing apparatus. Further, the medium 99 may be an article of clothing in any shape such as a T-shirt, or a three-dimensional object such as an article of tableware or stationery in any shape.

Technical ideas achieved by the above embodiment and modified examples and their advantageous effects will be described below.

Idea 1

A printing apparatus including a printing section configured to perform printing onto a medium while reciprocating in a movement area, and an attachment section to which a component can be attached, wherein the attachment section is movable between a first position above the movement area and a second position which is at least partially within the movement area.

With this configuration, contact between the attachment section and the printing section can be avoided by providing the attachment section at the first position during an operation such as printing. As the attachment section is moved from the first position to the second position, the attachment section comes to a lower position. As a result, the attachment section can be easily observed when attaching or detaching a component.

Idea 2

The printing apparatus according to the idea 1, wherein the attachment section is configured to be tiltable between the first position and the second position.

With this configuration, as the attachment section is tilted, the visual observation can be effectively improved while reducing the movable range of the attachment section.

Idea 3

The printing apparatus according to the idea 1 or 2, including a medium support section that supports the medium, wherein the printing section reciprocates between a first end and a second end of the movement area while traversing the medium support section when in printing, and stands-by at a stand-by position which is closer to the second end than to the medium support section when not in printing, and the attachment section is disposed at a position closer to the first end than to the medium support section.

With this configuration, the printing section stands-by at the stand-by position which is spaced from the attachment section when not in printing. As a result, the attachment section does not come into contact with the printing section when moving to the second position.

Idea 4

The printing apparatus according to any one of the ideas 1 to 3, wherein the component is a circuit board, and the attachment section includes a fixation frame which allows the circuit board is mounted thereon.

With this configuration, since the fixation frame comes to a lower position as the attachment section is moved from the first position to the second position, attachment and detachment of the circuit board can be easily performed.

Idea 5

The printing apparatus according to any one of the ideas 1 to 3, wherein the attachment section includes a circuit board and a fixation frame which allows the circuit board to be mounted thereon, and the component is a cable that is detachably attached to the circuit board.

With this configuration, since the fixation frame comes to a lower position as the attachment section is moved from the first position to the second position, the circuit board can be easily observed. As a result, attachment and detachment of the cable to and from the circuit board can be easily performed.

This application claims priority under 35 U.S.C. § 119 to Japanese Patent Application No. 2017-057140, filed Mar. 23, 2017. The entire disclosure of Japanese Patent Application No. 2017-057140 is hereby incorporated herein by reference.

What is claimed is:

1. A printing apparatus comprising:

a printing section configured to perform printing onto a medium while reciprocating in a movement area; and an attachment section to which a component can be attached, wherein the attachment section is movable between a first position above the movement area and a second position which is at least partially within the movement area, wherein the attachment section is configured to be tiltable between the first position and the second position.

2. The printing apparatus according to claim 1, comprising a medium support section that supports the medium, wherein the printing section reciprocates between a first end and a second end of the movement area while traversing the medium support section when in printing, and stands-by at a stand-by position which is closer to the second end than to the medium support section when not in printing, and the attachment section is disposed at a position closer to the first end than to the medium support section.

3. The printing apparatus according to claim 1, wherein the component is a circuit board, and the attachment section includes a fixation frame which allows the circuit board is mounted thereon.

4. The printing apparatus according to claim 1, wherein the attachment section includes a circuit board and a fixation frame which allows the circuit board to be mounted thereon, and the component is a cable that is detachably attached to the circuit board.

* * * * *